US006248032B1

(12) United States Patent
Filice et al.

(10) Patent No.: US 6,248,032 B1
(45) Date of Patent: Jun. 19, 2001

(54) GOVERNED PERFORMANCE ALUMINUM SHELL BAT

(75) Inventors: Gary W. Filice; Dewey Chauvin, both of Van Nuys, CA (US)

(73) Assignee: Jas. D. Easton, Inc., Van Nuys, CA (US)

( * ) Notice: Subject to any disclaimer, the term of this patent is extended or adjusted under 35 U.S.C. 154(b) by 0 days.

(21) Appl. No.: 09/375,833

(22) Filed: Aug. 16, 1999

(51) Int. Cl.[7] ..... A63B 59/06
(52) U.S. Cl. ..... 473/566
(58) Field of Search ..... 473/564–567, 473/457

(56) References Cited

U.S. PATENT DOCUMENTS 3,727,295 * 4/1973 Gildemeister ..... 473/566
3,729,196 * 4/1973 Heald, jr. ..... 473/566
3,735,463 * 5/1973 Merola ..... 473/566
3,801,098 * 4/1974 Gildemeister ..... 473/566
3,854,316 * 12/1974 Wilson ..... 473/566
3,963,239 * 6/1976 Fujii ..... 473/566
4,505,479 * 3/1985 Souders ..... 473/566
5,511,777 * 4/1996 McNeely ..... 473/566

* cited by examiner

*Primary Examiner*—Mark S. Graham
(74) *Attorney, Agent, or Firm*—Roth & Goldman

(57) ABSTRACT

A governed performance aluminum shell bat designed to ensure ball exit speed approximating and not exceeding that of a wood bat of comparable weight and geometry is comprised of a thin wall aluminum shell filled with syntactic foam in the hitting area, the foam having a density and hardness correlated with the thickness of the bat wall in the hitting area.

9 Claims, 2 Drawing Sheets

GOVERNED PERFORMANCE ALUMINUM SHELL BAT

BACKGROUND OF THE INVENTION AND PRIOR ART

1. Field of the Invention

The present invention relates to aluminum baseball bats which currently are used at the college and lower levels. Such bats typically include a metal shell formed of aluminum or aluminum alloy or other metals, such bats being used not only in baseball but also in softball at such substantially all levels of non-professional levels of play. As referred to herein, the term "aluminum" is intended to encompass aluminum alloys formulated for the manufacture of bat shells.

Recently, the National Collegiate Athletic Association (NCAA) has indicated that, for player safety reasons, the batted ball exit speed for non-wood bats should equate to or not exceed the highest average exit speed using major league baseball quality, 34 inch solid wood bats. Bats meeting these specifications are expected to result in lower incidences of harm to ball players.

2. Prior Art

U.S. Pat. No. 5,395,108 Souders, et al issued Mar. 7, 1995 for a SIMULATED WOOD COMPOSITE BALL BAT comprises a fiber reinforced composite shell filled with expansible urethane foam to develop compressive stresses therebetween.

U.S. Pat. No. 5,114,144 issued May 19, 1992 to Baum discloses a composite baseball bat made to look like a wood bat by using a central core of foamed plastic (foam density of 5–15 lbs/cu. ft.) or extruded aluminum covered with a layer of resin impregnated fiber knitted or woven cloth and a surface layer of longitudinally extending planks or strips of resin coated wood veneer.

U.S. Pat. No. 5,460,369 issued Oct. 24, 1995 to Baum discloses a composite bat having a wood veneer surface bonded to a composite tubular core.

U.S. Pat. No. 5,533,723 issued Jul. 9, 1996 to Baum discloses a composite bat having a wood veneer surface and intermediate composite layer bonded to a tubular core of composite or aluminum. The core may comprise a resilient urethane foam and a cavity may be left in the core in the hitting area and the cavity may be filled with less dense material. The core may vary in density over the length of the bat, preferably with a higher density section near the barrel end.

U.S. Pat. No. 5,458,330 issued Oct. 17, 1995 to Baum discloses a composite bat having a wood veneer surface and cavitied foam core.

OBJECT OF THE INVENTION

The primary objective of the invention is to provide a durable aluminum shell baseball bat in which the ball rebound characteristics approximate those of a wood bat.

SUMMARY OF THE INVENTION

The present invention provides a governed performance aluminum shell ball bat comprising:

a) an aluminum alloy shell having a maximum outside diameter in the ball striking area and a ratio of said maximum outside diameter to the wall thickness of the shell in the hitting area in the range of from 45:1–90:1; and b) a syntactic foam substantially filling the interior of the bat shell in the hitting area, said foam having a density in the range of 10–30 lbs./cu. ft. and a hardness on a Shore D test apparatus in the range of 40–65.

DESCRIPTION OF THE PREFERRED EMBODIMENT

Figure 1:
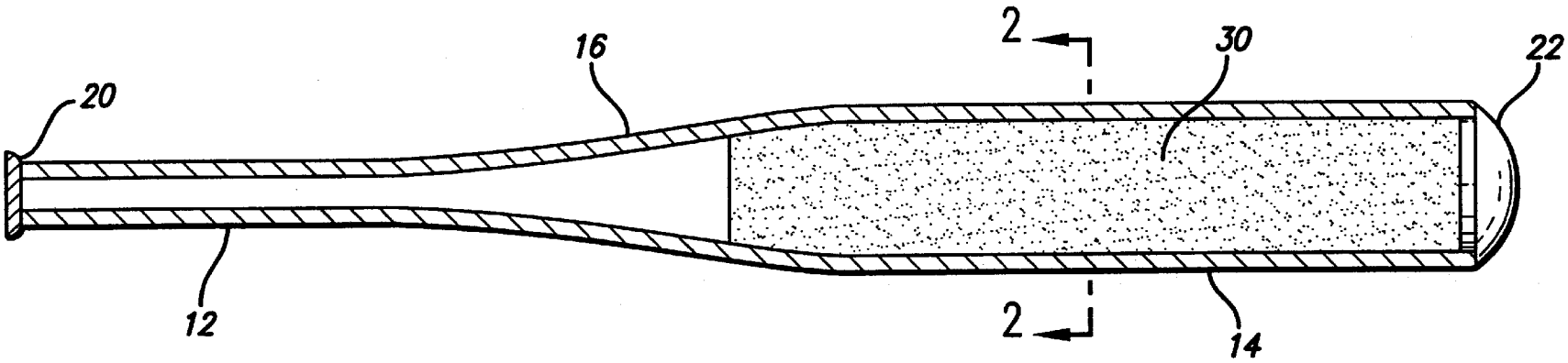
FIG. 1 is a longitudinal cross-section of a bat according to the present invention.
Figure 2:
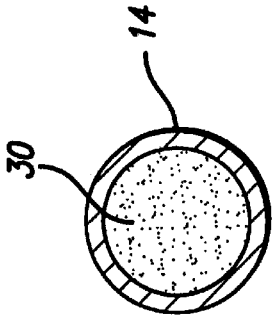
FIG. 2 is a transverse cross-section, taken through the hitting area, of the bat of FIG. 1.

As seen in FIGS. 1 and 2, the baseball bat comprises an aluminum alloy shell 10 having a handle 12, a barrel 14 and a tapered section 16 interconnecting the handle and the barrel. A knob 20 closes the handle end of the bat and a plug 22 is typically affixed to the barrel end of the bat as is well known. The ball striking area of the bat generally extends through the full length of the barrel section 14 partially into the tapered section 16 of the bat.

Performance of the bat of the present invention is intentionally designed to match or closely approximate the performance of a typical wood bat of similar weight and geometry. Since aluminum has a much higher stiffness and density than that of wood and wood-like synthetic materials, an aluminum bat made with the same approximate outside shape or geometry and the same approximate weight would have an undesirable high longitudinal stiffness of as much as 2.5 to 3.0 times that of the wood bat. The shell wall thickness of such a bat, because of the low cross sectional stiffness and high strength of aluminum, enables the wall to recover to its original shape after an impact with a ball despite significant localized cross-sectional distortion of the bat wall during ball impact. In comparison, wood bats have a high cross-sectional stiffness as well as the lower longitudinal stiffness previously mentioned.

Known prior art composite bats and aluminum bats with resilient foam fillers are intentionally designed to permit flexing of the outer bat wall to generate a rebound or trampoline effect following impact with a batted ball to propel the ball with added velocity. Since the objective of the present invention is to govern or reduce the speed of the batted ball to no more than would be experienced with a wood bat, a reduced bat shell wall thickness in the hitting area to minimize or substantially eliminate the trampoline effect has been developed. Resilient foams are not appropriate for such bats.

The bat of the present invention is comprised of an aluminum alloy shell in which the outside diameter of the barrel 14 has a much thinner wall in the hitting area (generally the barrel 14 and part of the tapered section 16), the ratio of the outside diameter of the barrel 14 to the wall thickness of the shell in the hitting area being in the range of from 45:1–90:1. This thin wall shell 10 is used in conjunction with a relatively rigid (as compared with prior art) foam filler 30 comprising a syntactic foam which substantially fills the interior of the bat shell 10 in the hitting area. Syntactic foam is a plastic non-blown foam having bubbles mixed in as by mixing microspheres with the foam components rather than by forming bubbles in the foam during curing of the foam components. It has been found that a foam having a density in the range 10–30 lbs./cu. ft. and a hardness, when measured on a Shore-D test apparatus, in the range of 40 to 65 is required for the thin wall bat shell 10 described. At the present time, applicant prefers to use a thermosetting resin foam having microspheres mixed therein; however, it is contemplated that foams formed from other than thermosetting resins can be employed. The presently preferred foam is di-cyclopentadiene (DCPD) resin.

Figure 3:
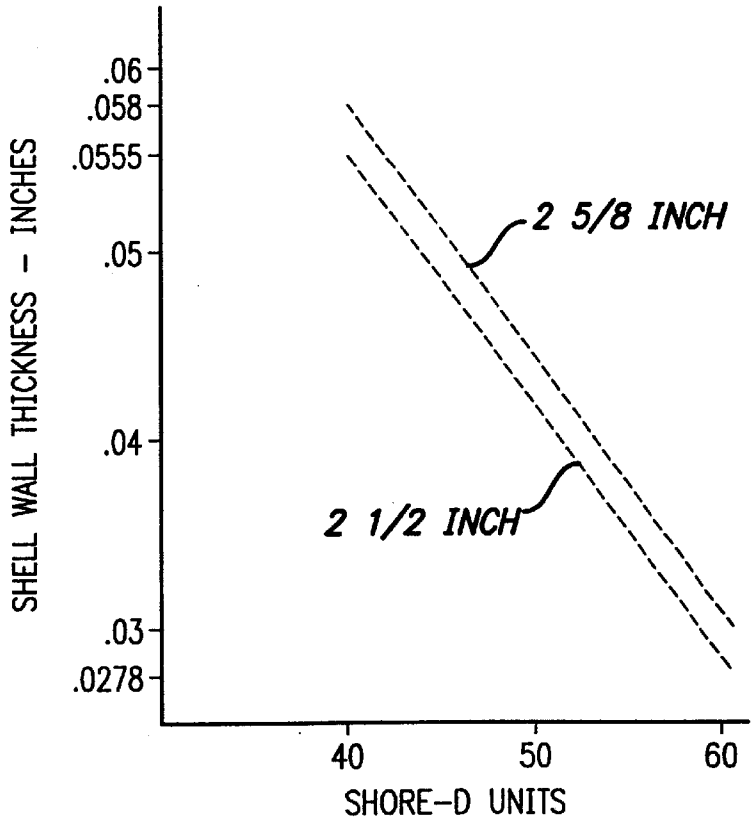
FIG. 3 is a graph illustrating the relationship of various bat parameters including outside diameter in the hitting area, shell wall thickness, density and Shore D hardness of a foam filler.
Figure 3:
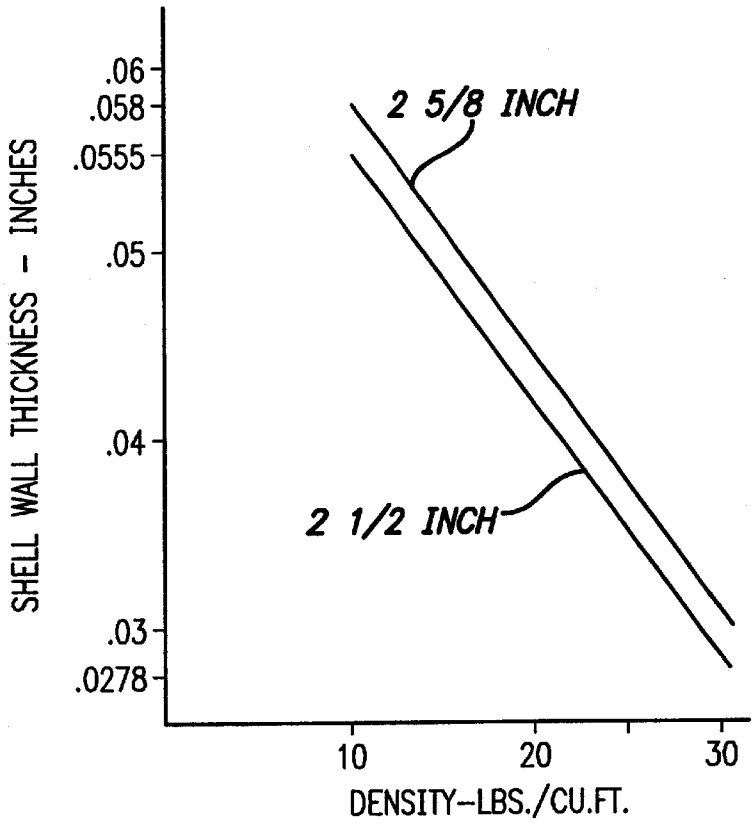

In order to obtain suitable performance characteristics, which meet the objectives of the invention, the relationship between the characteristics of the foam and the wall thickness of the aluminum shell, in the hitting area, must be maintained. In general, lower foam densities can be used for thicker shell wall thicknesses without materially affecting the weight of the bat. As the shell wall thickness decreases, a more dense foam is required to maintain proper weight and balance. Also, the foam 30 must be harder to minimize radial displacement of the shell 10 during ball impact. FIG. 3 shows two families of curves, one for a bat having 2⅝ inch outside diameter and the second for a bat having a 2½ inch outside diameter. The density curves are shown in solid lines and the hardness curves are shown in dashed lines. The shell wall thickness in inches is shown on the ordinate and the density, expressed in lbs/cu. ft. and the hardness, expressed as Shore-D units, are each shown on the abscissa. Typically, a 2⅝ inch bat should have a shell wall thickness in the range of from 0.03 inches to about 0.06 inches so that the shell is adequately durable without becoming too heavy. A lower density foam as low as 10 lbs./cu. ft. thus should be used with thicker bat shell walls whereas a more dense foam of as high as 30 lbs./cu. ft. is required when the shell wall thickness is as low as about 0.03 inches. Similarly, a foam hardness of about 40 on a Shore-D test apparatus has been found to be adequate provided the shell wall thickness is near the upper end of the range, e.g., (about 0.06 inches) but a harder foam material is required when the thickness of the shell wall in the hitting area decreases to a value of about 0.03 inches. Also shown on the graph are similar curves for a 2½ inch bat which will have correspondingly lower shell wall thickness and, foam density and foam hardness.

The foam 30 may be introduced into the aluminum bat shell 10 in the hitting area in various ways, for example, by pressing in a pre-molded foam core while the foam is still malleable, or by transfer molding, injection molding, infusion molding or by pouring uncured resin and hardener components and microspheres together into the bat shell 10 and allowing the resin foam to cure in place. Preferably, the foam should have a shrinkage factor of less than 1% during curing to prevent the formation of void spaces between the inner shell wall and foam or internally of the foam itself. Undesired void spaces may be formed during either the filling process or during ordinary use of the bat.

It should be noted that no adhesive bonding agent between the aluminum shell 10 and the syntactic foam 30 is essential, particularly if the foam is injected or poured into the shell and is cured in place since resin foams typically expand during the curing process resulting in significant compressive interengagement between the foam 30 and the shell 10. Also, it is contemplated that the aluminum shell 10 may be heated during the manufacturing process to expand to a diameter greater then nominal, the shell then being allowed to cool and shrink to its intended final diameter as the foam cures, thus generating significant compressive stresses between the shell and foam to hold the foam in place without a separate adhesive bond. The cured foam is characterized by the substantially complete absence of voids or cavities in the foam and between the foam and the bat shell in the hitting area.

It will be appreciated that the heavier the foam and thicker the shell wall, the heavier the bat; and the thinner the bat wall, the greater the necessity for a dense and hard foam. Since compression and shear strength of foams drop as density drops a very thin aluminum shell wall requires a more rigid foam. The foam also must not significantly interfere with the desired and designed in longitudinal flex of the shell which must be maintained since, as previously mentioned, aluminum has a much higher stiffness and density then that of wood.

Longitudinal flexibility characteristics of the bat are matched to those of a wood bat of corresponding weight and geometry by determining handle and barrel flexibility separately. The handle test is performed by supporting the handle 12 of the bat at two spaced locations about 15 inches apart, one point of support being adjacent the knob 20. A vertical load, preferably about 80 pounds, is then applied to the handle 12 at the mid-point of the span, i.e., 7.5 inches from either point of support, to ensure that the applied load causes a desired deflection similar to that caused by the same load applied to a wood bat. Test results indicate that the desired deflection is in the range of about 0.046–0.055 inches.

The barrel flexibility is similarly tested by supporting the barrel section 14 of the bat at two spaced locations about 15 inches apart. A vertical load, preferably about 80 pounds, is then applied to the barrel 14 at the mid-point of the span, i.e., 7.5 inches from either point of support, to ensure that the applied load causes a desired deflection similar to that caused by the same load applied to a wood bat. Test results indicate that the desired deflection is about 0.0046 inches.

Persons skilled in the art will appreciate that various modifications of the invention can be made from the above described preferred embodiment and that the scope of protection is limited only by the following claims.

What is claimed is:

1. A governed performance aluminum shell ball bat comprising:

a) an aluminum alloy shell having a maximum outside diameter in a ball striking area and a ratio of said maximum outside diameter to a wall thickness of the shell in the ball striking area in the range of from 45:1–90:1; and b) a syntactic foam substantially filling the bat shell in the ball striking area, said foam having a density in the range of 10–30 lbs./cu. ft. and a hardness on a Shore D test apparatus in the range of 40–65.

2. The governed performance bat of claim 1, wherein said foam is a thermosetting resin having micro-bubbles mixed therein.

3. The governed performance bat of claim 2, wherein said foam is di-cyclopentadiene (DCPD) resin.

4. The governed performance bat of claim 3, wherein said shell has a wall thickness in the ball striking area in the range of 0.0278–0583 inches.

5. The governed performance bat of claim 4, characterized by the absence of an adhesive bond between said aluminum shell and said syntactic foam.

6. The governed performance bat of claim 5, wherein said foam is compressively restrained in the shell.

7. The governed performance bat of claim 6, characterized by the absence of cavities in said foam in the ball striking area.

8. The governed performance bat of claim 7, wherein said foam has a shrinkage factor during curing of not greater than 1.0%.

9. The governed performance bat of claim 8, having an outside diameter in the ball striking area of about 2⅝ inches and wherein the density of said foam is about 25 pounds per cubic foot and the Shore D hardness of said foam is about 55.

* * * * *